US009025803B2

(12) United States Patent
Sacha

(10) Patent No.: US 9,025,803 B2
(45) Date of Patent: May 5, 2015

(54) HEARING AID MAGNETIC SENSOR WITH COUNTER WINDINGS

(75) Inventor: Michael Karl Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/422,154

(22) Filed: Mar. 16, 2012

(65) Prior Publication Data

US 2012/0294468 A1 Nov. 22, 2012

Related U.S. Application Data

(60) Provisional application No. 61/454,348, filed on Mar. 18, 2011.

(51) Int. Cl.
*H04R 25/00* (2006.01)

(52) U.S. Cl.
CPC ..... *H04R 25/554* (2013.01); *H04R 2225/49* (2013.01); *H04R 2225/51* (2013.01)

(58) Field of Classification Search
USPC ..... 381/324, 331, 312, 315; 379/443
See application file for complete search history.

(56) References Cited

U.S. PATENT DOCUMENTS

| | | | | | |
|---|---|---|---|---|---|
| 5,046,133 | A * | 9/1991 | Watanabe et al. | ..... | 455/138 |
| 5,557,673 | A * | 9/1996 | Ginzburg | ..... | 379/443 |
| 6,466,679 | B1 * | 10/2002 | Husung | ..... | 381/324 |
| 2008/0021281 | A1 | 1/2008 | Fujimori | | |

FOREIGN PATENT DOCUMENTS

| | | | | | |
|---|---|---|---|---|---|
| EP | 1196008 | A2 | 4/2002 | | |
| EP | 1196008 | * | 10/2002 | ..... | H04R 25/00 |
| EP | 2501158 | A1 | 9/2012 | | |
| WO | WO-03001844 | A1 | 1/2003 | | |
| WO | WO 03001844 | * | 3/2003 | ..... | H04R 25/00 |

OTHER PUBLICATIONS

"Application Serial No. 12159887.4, European Search Report mailed Jun. 18, 2012", 6 pgs.
Goldberg, Hyman, "Telephone Amplifying Pick-Up Devices", Hearing Instruments, (Sep. 1975), 19-20.
European Application Serial No. 12159887.4, Response filed Mar. 19, 2013 to Office Action mailed Sep. 24, 2012, 16 pgs.
European Application Serial No. 12159887.4, Office Action mailed Sep. 24, 2012, 2 pgs.

* cited by examiner

*Primary Examiner* — Davetta W Goins
*Assistant Examiner* — Amir Etesam
(74) *Attorney, Agent, or Firm* — Schwegman Lundberg & Woessner, P.A.

(57) ABSTRACT

A hearing aid includes a magnetic sensor to sense a sound signal being a magnetic field. The magnetic sensor includes a telecoil to sensor the sound signal and a counter coil to cancel a noise signal resulting from electromagnetic interference. In one embodiment, a driver circuit for the counter coil allows for automatic adjustment of the hearing aid circuit for an interference null.

20 Claims, 11 Drawing Sheets

HEARING AID MAGNETIC SENSOR WITH COUNTER WINDINGS

CLAIM OF PRIORITY

The present application claims the benefit under 35 U.S.C. §119(e) of U.S. Provisional Patent Application Ser. No. 61/454,348, filed on Mar. 18, 2011, which is incorporated herein by reference in its entirety.

TECHNICAL FIELD

This document relates generally to hearing assistance systems and more particularly to a hearing aid with a magnetic sensor that includes a telecoil for sensing a sound signal and counter windings for canceling interference.

BACKGROUND

Hearing aids are used to assist patients suffering hearing loss by transmitting amplified sounds to ear canals. Some hearing aids include magnetic sensors that pick up sounds transmitted as magnetic signals. A telecoil, also referred to as a T-coil, T-switch, or a telephone switch, is such a magnetic sensor in a hearing aid that senses a magnetic signal representing a sound and, in response, generates an electrical signal representing the sound. The electrical signal causes a receiver (speaker) of the hearing aid to deliver the sound to an ear canal of the wearer. The magnetic signal may be generated from, for example, a hearing aid compatible telephone, an assistive listening system, or an assistive listening device. A hearing aid may turn off its microphone when its telecoil is turned on, such that the wearer hears the sound represented by the magnetic signal but not acoustic noises. The telecoil also eliminates acoustic feedback associated with using the microphone of the hearing aid to listen to a telephone. However, the telecoil is also sensitive to various magnetic noises present in the environment in which it is deployed. Thus, there is a need to provide the wearer of the hearing with clearing hearing when the telecoil is used in the presence of magnetic noises.

SUMMARY

A hearing aid includes a magnetic sensor to sense a sound signal being a magnetic field. The magnetic sensor includes a telecoil to sensor the sound signal and a counter coil to cancel a noise signal resulting from electromagnetic interference. In one embodiment, a driver circuit for the counter coil allows for automatic adjustment of the hearing aid circuit for an interference null.

In one embodiment, the hearing aid includes a magnetic sensor, a processor, and a receiver. The magnetic senses a sound signal being a sound magnetic field representing a sound and includes a telecoil and a counter coil. The telecoil senses the sound signal. The counter coil allows for generation of a counter signal being a counter magnetic field having a direction approximately opposite to the direction of a noise signal being an ambient magnetic field. The processor processes the sound signal. The receiver delivers the processed sound signal to the ear canal of a wearer of the hearing aid.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing aid with a magnetic sensor that includes a telecoil and a counter coil. The telecoil is a coil that picks up a sound signal that is a magnetic field representing a sound. In various embodiments, the sound signal is a sound magnetic field generated by a hearing aid compatible device that transmits sounds as magnetic signals, such as certain telephones, assistive listening systems, and assistive listening devices. The hearing aid converts the sound signal back to the sound and delivers that sound to a wearer's ear canal. The "counter coil" is a coil that is used to generate a counter signal that is a counter magnetic field for canceling a noise signal being an ambient magnetic field. In various embodiments, the ambient magnetic field represents the sum of electromagnetic interferences, or a net noise magnetic field, that will be picked up by the telecoil as the sound signal when the counter coil is unused or inactive. In various embodiments, such electromagnetic interferences includes magnetic field generated by components within the hearing aid. The counter coil is used to generate a counter magnetic field that is aimed to cancel the ambient magnetic field. Thus, in various embodiments, the counter coil is constructed and placed in the hearing in a way that allows for generation of a counter magnetic field having amplitude approximately equal to the amplitude of the ambient magnetic field and a direction approximately 180-degree opposite to the direction of the ambient magnetic field. When the counter coil is active, the telecoil picks up the sum of the sound signal, the noise signal, and the counter magnetic field. The signal-to-noise ratio is maximized when the sum of the noise signal and the counter magnetic field is minimized.

Figure 1:
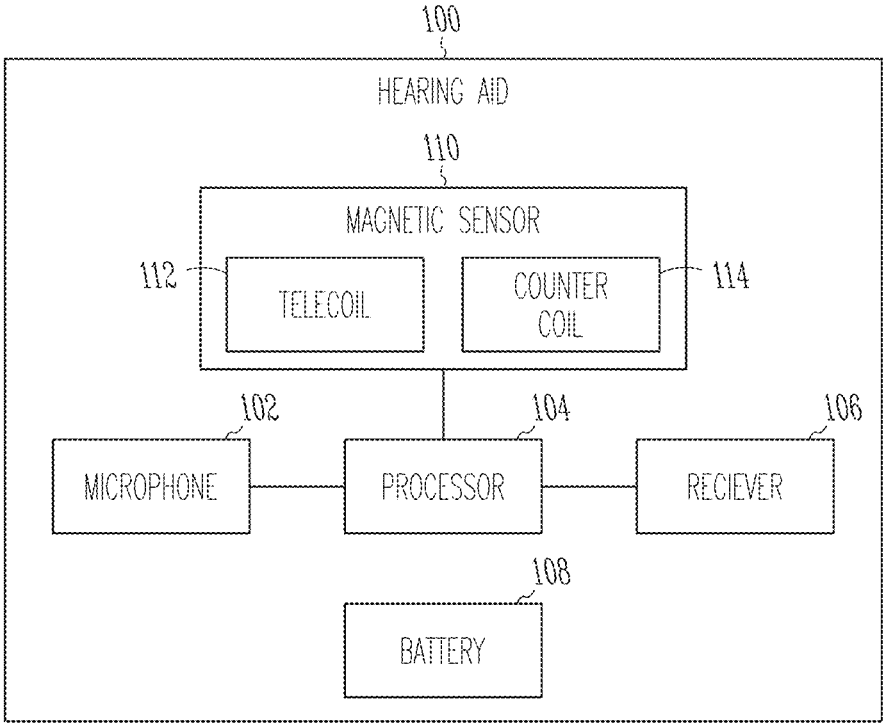
FIG. 1 is a block diagram illustrating an embodiment of a hearing aid including a magnetic sensor.

FIG. 1 is a block diagram illustrating an embodiment of a hearing aid 100 including a magnetic sensor 110. Magnetic sensor 110 includes a telecoil 112 and a counter coil 114. Telecoil 112 senses the sound signal. Counter coil 114 generates the counter signal. Hearing aid 100 also includes a microphone 102 to receive an audio signal, a processor 104 to process the audio signal received by microphone 110 and the sound signal sensed by telecoil 112, and a receiver (speaker) 106 to deliver the processed audio signal and sound signal as a sound to the ear canal of the wearer of hearing aid 100. Hearing aid also includes a battery 108 that supplies power for its operation. In one embodiment, processor 104 turns microphone 102 off in response to receiving the sound signal from telecoil 112. In one embodiment, hearing aid 110 picks up the sound signal only and does not include microphone 102.

Figure 2:
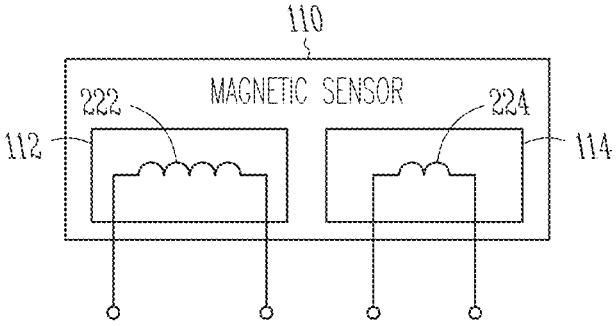
FIGS. 2 and 3 are illustrations of concept of a magnetic sensor including a telecoil and a counter coil.
Figure 3:
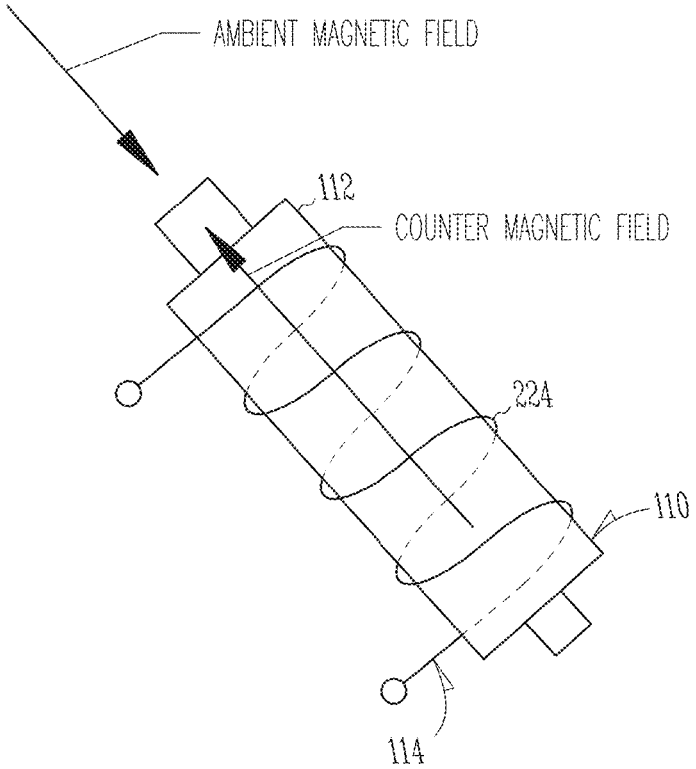

FIGS. 2 and 3 are illustrations of a concept of magnetic sensor 110, which includes telecoil 112 and counter coil 114. Telecoil 112 includes telecoil windings 222 configured to sense the sound signal. Counter coil 114 includes counter windings 224 configured to generate the counter signal. In various embodiments, counter windings 224 allow for generation of the counter signal having a direction that is approximately 180-degree opposite to the direction of the sound signal, to cancel the noise signal in the direction of the sound signal. In other words, the counter magnetic field has a direction that is approximately 180-degree opposite to the direction of the sound magnetic field, to counter the ambient magnetic field in the direction of the sound magnetic field. This is achieved, for example, by winding wires of telecoil windings 222 and counter windings 224 in opposite directions. In one embodiment, telecoil windings 222 and counter windings 224 are coaxial. In one embodiment, as illustrated in FIG. 3, counter coil 114 is formed by winding wire over telecoil 112.

Figure 4:
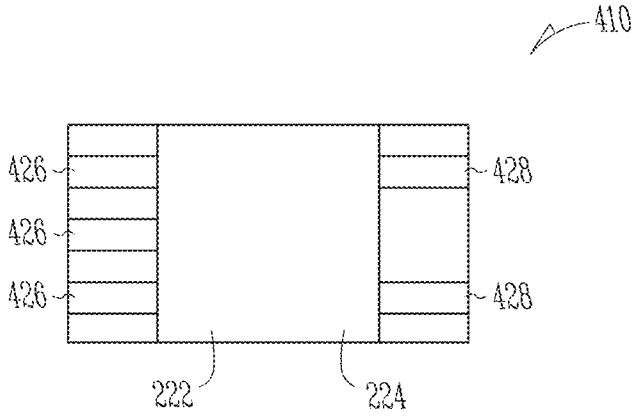
FIG. 4 is an illustration of an embodiment of the magnetic sensor with connectors.

FIG. 4 is an illustration of an embodiment of a magnetic sensor 410. Magnetic sensor 410 represents an embodiment of magnetic sensor 110 and integrates telecoil 112 and counter coil 114 with their connectors into a single device for use in hearing aid 100. In the illustrated embodiment, magnetic sensor device 410 includes telecoil windings 222, telecoil connectors 426 (allowing for electrical connections to telecoil windings 222), counter windings 224, and counter coil connectors 428 (allowing for electrical connections to counter coil windings 224). In one embodiment, telecoil connectors 426 and counter coil connectors 428 are each a soldering pad.

Figure 5:
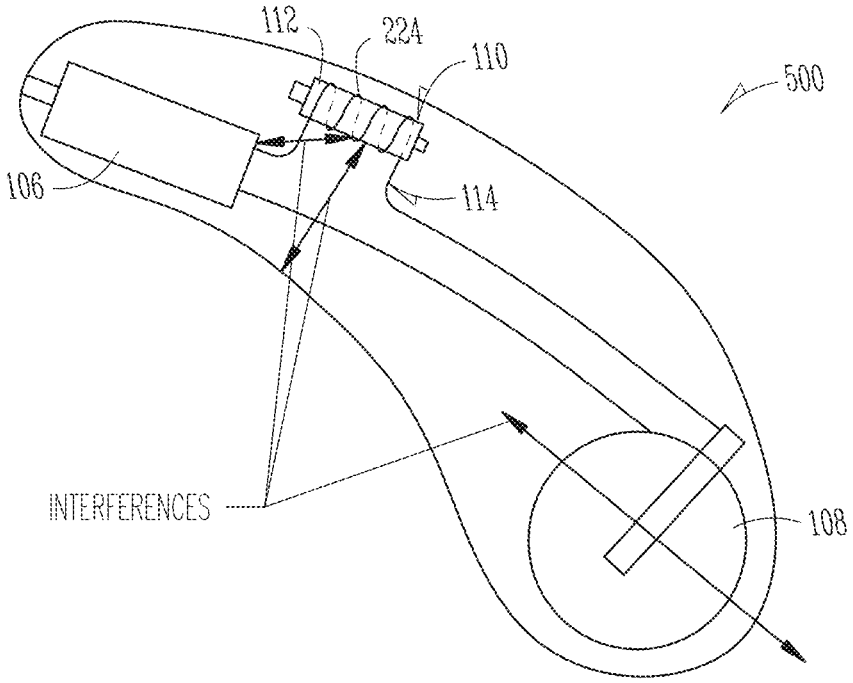
FIG. 5 is an illustration of an embodiment of the hearing aid.

FIG. 5 is an illustration of an embodiment of a hearing aid 500 showing electromagnetic interferences generated from various components in the hearing aid. In a specific embodiment, as illustrated in FIG. 5, counter coil 114 is used to counter the magnetic field generated by receiver 106 when it delivers a sound to the ear canal. In one embodiment, counter coil 114 is formed with counter windings 224 over telecoil 112 in a direction that is approximately opposite of the direction of the coil windings in receiver 106. The electrical signal flowing through the coil of receiver 106 is used to drive the counter coil, such that when the ambient magnetic field is generated by receiver 106, magnetic sensor 110 generates the counter magnetic field that cancels the ambient magnetic field.

Figure 6:
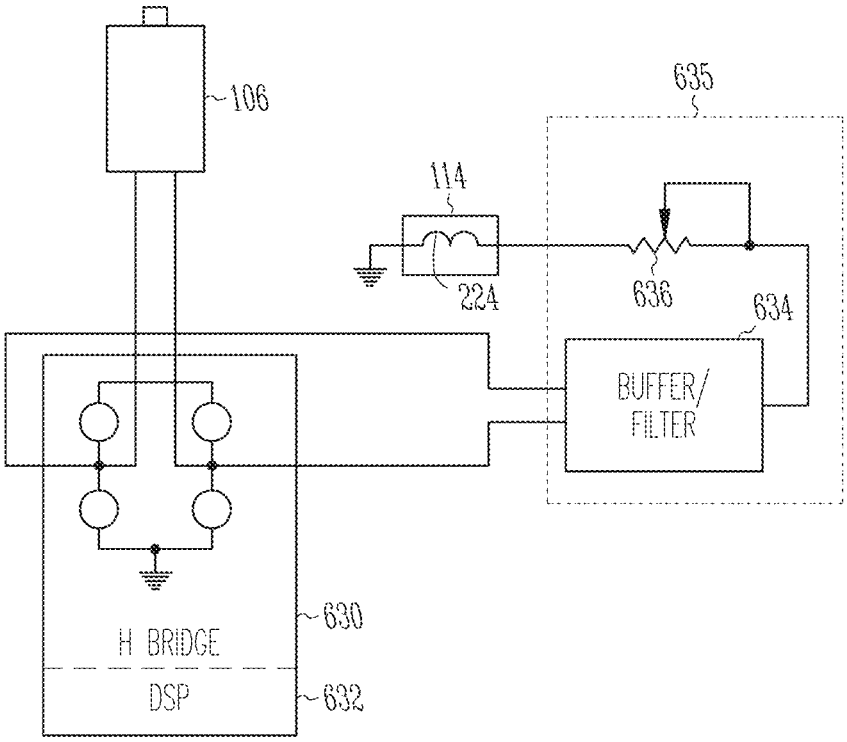
FIG. 6 is a circuit schematic/block diagram illustrating an embodiment of a driver circuit for the counter coil to counter receiver emission.

FIG. 6 is a circuit schematic/block diagram illustrating an embodiment of a driver circuit 635 for driving counter coil 114 to counter receiver emission, i.e., the ambient magnetic field generated by receiver 106. Driver circuit 635 is part of the circuit of hearing aid 100 or 500 and drives counter coil 114 to generate the counter signal for cancelling the magnetic field generated by receiver 106. Driver circuit 635 receives a receiver signal from receiver 106. An H bridge circuit 630 is coupled between receiver 106 and driver circuit 635 to provide controllable routing of the receiver signal to driver circuit 635. H bridge circuit 630 is an electronic circuit that allows for control of polarity of the receiver signal as received by driver circuit 635 and hence the current flowing through counter windings 224. In the illustrated embodiment, driver circuit 635 is an active circuit including a buffer/filter 634 and a current adjuster 636. In various embodiments, current adjuster 636 includes a variable resistor or a current source. Buffer/filter 634 buffers and/or filters the receiver signal. Current adjuster 636 scales the receiver signal before it flows through counter windings 224, thereby adjusting for interference null.

In the illustrated embodiment, buffer/filter 634 samples the receiver signal from receiver 106 and low-pass filters the receiver signal to convert a pulse-position modulated (PPM) signal to an audio signal. Current adjuster 636 scales the audio signal before passing it through counter windings 224. Depending on the coupling and number of turns of counter coil 224, a null is developed by adjusting the audio signal using current adjuster 636. When the adjustment is approximately optimally performed for the receiver emission, cancellation of the interference by up to 30 dB can be achieved.

In one embodiment, a digital signal processor (DSP) 632 of the hearing aid automatically controls the process of adjusting for the interference null. In one embodiment, processor 104 includes DSP 632. In one embodiment, DSP 632 sends a test signal to receiver 106. Depending on the telecoil placement (close to receiver or battery lead), this creates a high current condition that would allowing for sensing of the signal at the location of the telecoil for DSP 632 to perform an automatic current scaling routine that determines an interference null.

Figure 7:
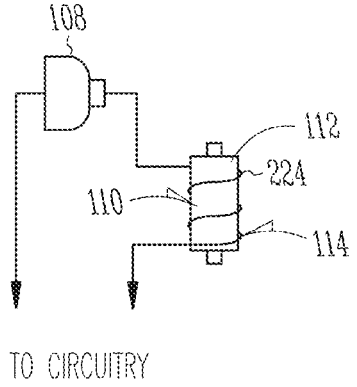
FIG. 7 is an illustration of an embodiment of the counter coil used to counter battery emission.

FIG. 7 is an illustration of an embodiment of counter coil 114 used to counter battery emission, i.e., an ambient magnetic field generated by battery 108. Depending on the placement of the telecoil in a hearing aid, the predominant source of electromagnetic interference may vary. In various embodiments, the predominant source of electromagnetic interference is from receiver emission, and a counter magnetic field is generated using the circuit illustrated in FIGS. 5 and 6. In various other embodiments, the predominant source of electromagnetic interference is from battery emission, and a similar driver circuit is used to drive counter coil 114 using a battery signal. In the embodiment illustrated in FIG. 7, when the ambient magnetic field is generated by battery 108, magnetic sensor 110 generates the counter signal for cancelling the ambient magnetic field.

Figure 8:
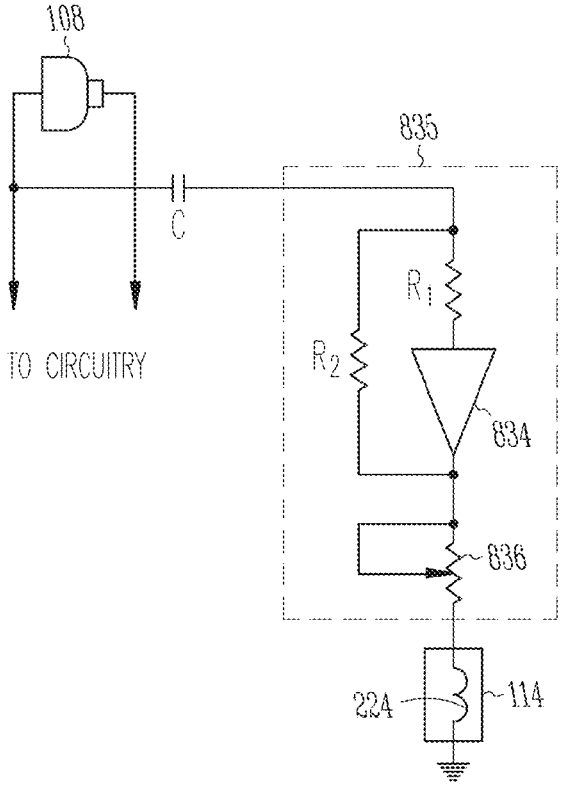
FIG. 8 is a circuit schematic/block diagram illustrating an embodiment of a driver circuit for the counter coil used to counter the battery emission.

FIG. 8 is a circuit schematic/block diagram illustrating an embodiment of a driver circuit 835 for driving counter coil 114 to counter the battery emission. In one embodiment, driver circuit 835 is part of the circuit of hearing aid 100 or 500 and drives counter coil 114 to generate the counter signal for cancelling the magnetic field generated by battery 108. In the illustrated embodiment, driver circuit 835 is an active circuit including a buffer 834 and a current adjuster 836. Driver circuit 835 receives an AC-coupled battery signal from battery 108 through a coupling capacitor C. In various embodiments, current adjuster 836 includes a variable resistor or a current source. Buffer 834 buffers the battery signal. Current adjuster 836 scales the battery signal before it flows through counter windings 224, thereby adjusting for interference null. In one embodiment, values of resistors R1 and R2 are selected to provide for non-adjustable of the battery signal scaling in addition to the adjustable scaling provided by current adjuster 836. In another embodiment, values of resistors R1 and R2 are selected to provide for non-adjustable of the battery signal scaling instead of the adjustable scaling provided by current adjuster 836, thereby eliminating the need for current adjuster 836 if the adjustable scaling is found to be unnecessary.

In the illustrated embodiment, current adjuster 836 scales the battery signal before passing it through counter windings 224. Depending on the coupling and number of turns of counter coil 224, a null is developed by adjusting the battery signal using current adjuster 836. In one embodiment, an H bridge circuit similar to circuit 630 is coupled between battery 108 and driver circuit 835 to control the direction of the current signal flowing through counter windings 224, and/or a DSP similar to DSP 632 to automatically control the process of adjusting for the interference null.

In various embodiments, presence of static magnetic field, such as the field from a landline telephone handset placed near the hearing aid wearer's ear, is to be considered when adjusting for the interference null. The static magnetic field may alter coupling between telecoil windings 222 and counter coil windings 224.

Various approaches may be taken to drive the counter coil and adjust for the interference null. In one embodiment, the interference null is adjusted by experimentally determining the number of turns of counter coil 114, without using active circuitry. However, such adjustment is difficult in practice. In another embodiment, appropriate resistors (such as R1 and R2) are selected to scale the current flowing through counter windings 224 to adjust for the interference null. In another embodiment, a DSP of the hearing aid is used with firmware to adjust for the interference null automatically. In another embodiment, feedback cancellation is applied to initiate the adjustment for the interference null in response to detection of feedback.

In various embodiments, use of the counter coil as discussed in this document eliminates or minimizes the usage of shielding material in a hearing aid. In various embodiments, use of the counter coil as discussed in this document provides for tuning the circuit of the hearing aid to an interference null instead of trial and error methods of placing shielding. In various embodiments, use of the counter coil as discussed in this document may provide for an attenuation of electromagnetic interference by 30 dB, which is greater than using adaptive filter approaches (that typically provides an attenuation of 10-15 dB). In various embodiments, use of the counter coil as discussed in this document provides for automation in reducing telecoil feedback interference.

FIGS. 9-14 present examples of performance evaluation for a counter coil such as counter coil 114 as discussed in this document. Results of the performance evaluation show effectiveness of counter coil 114 in reducing the electromagnetic interference in the sound signal sensed by telecoil 112.

Figure 9:
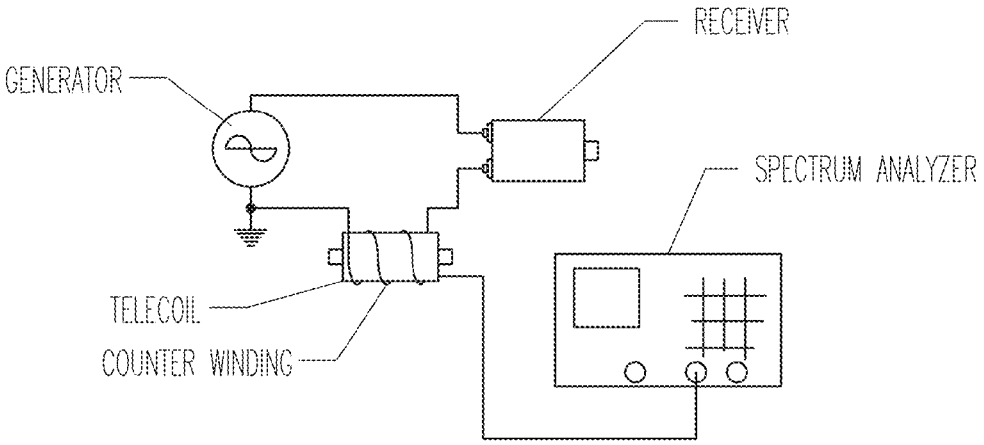
FIG. 9 is a circuit schematic/block diagram illustrating a measurement setup for evaluating performance of a counter coil.
Figure 10:
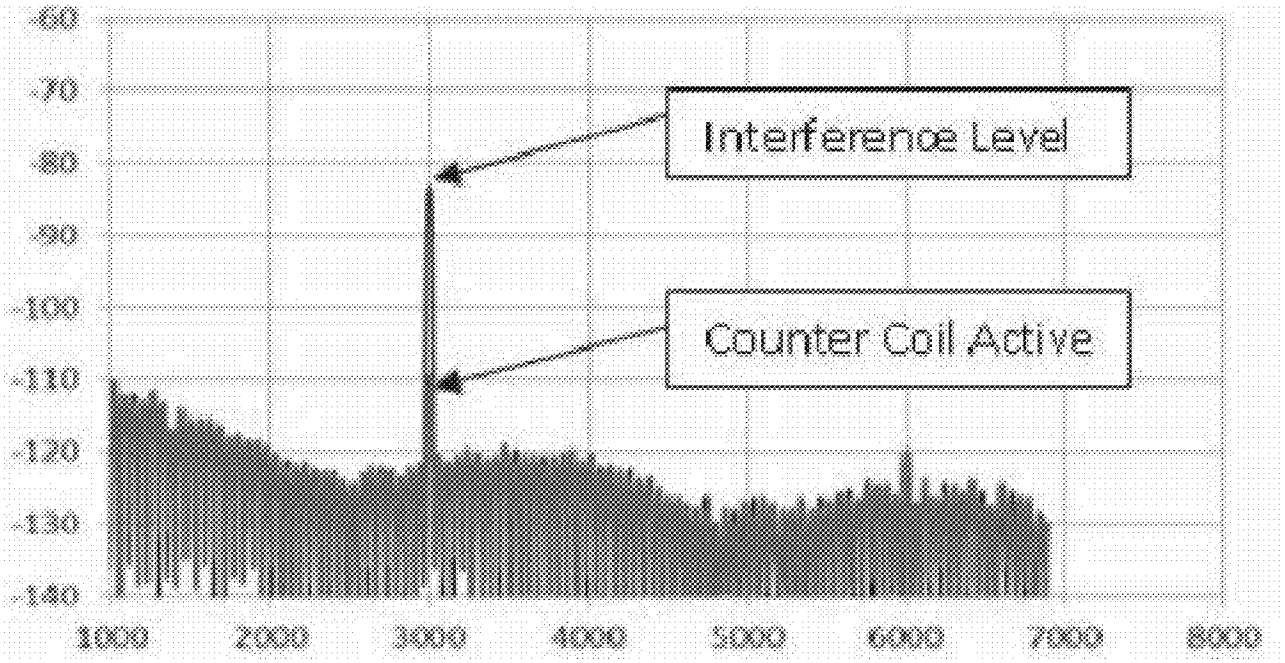
FIG. 10 is a graph showing results of an evaluation using the setup of FIG. 9.

FIG. 9 is a circuit schematic/block diagram illustrating a measurement setup for evaluating performance of the counter coil. The telecoil and the receiver were placed 0.25 inch apart from each other. The counter coil was formed by adding counter windings over the telecoil. No active circuit was used to adjust for the interference null. FIG. 10 is a graph showing results of an evaluation using the setup of FIG. 9. Results of spectrum analysis of the sound signal with the counter coil being inactive ("Interference Level") and with the counter coil being active ("Counter Coil Active") are presented. The results show that the counter windings when being active provide for an attenuation of electromagnetic interference by about 30 dB.

Figure 11:
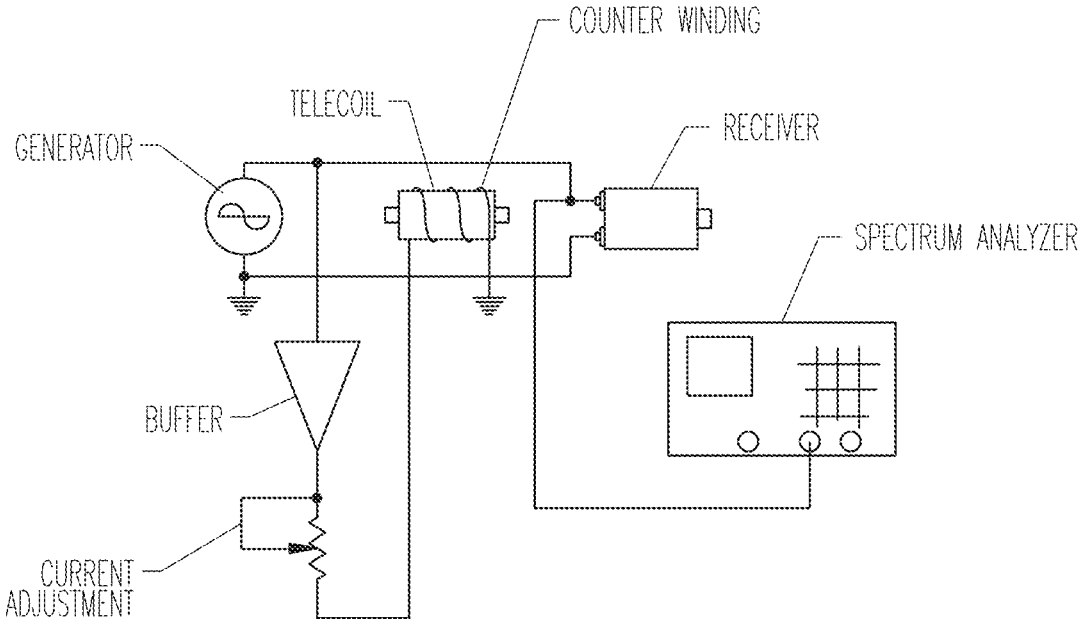
FIG. 11 is a circuit schematic/block diagram illustrating another measurement setup for evaluating performance of a counter coil.
Figure 12:
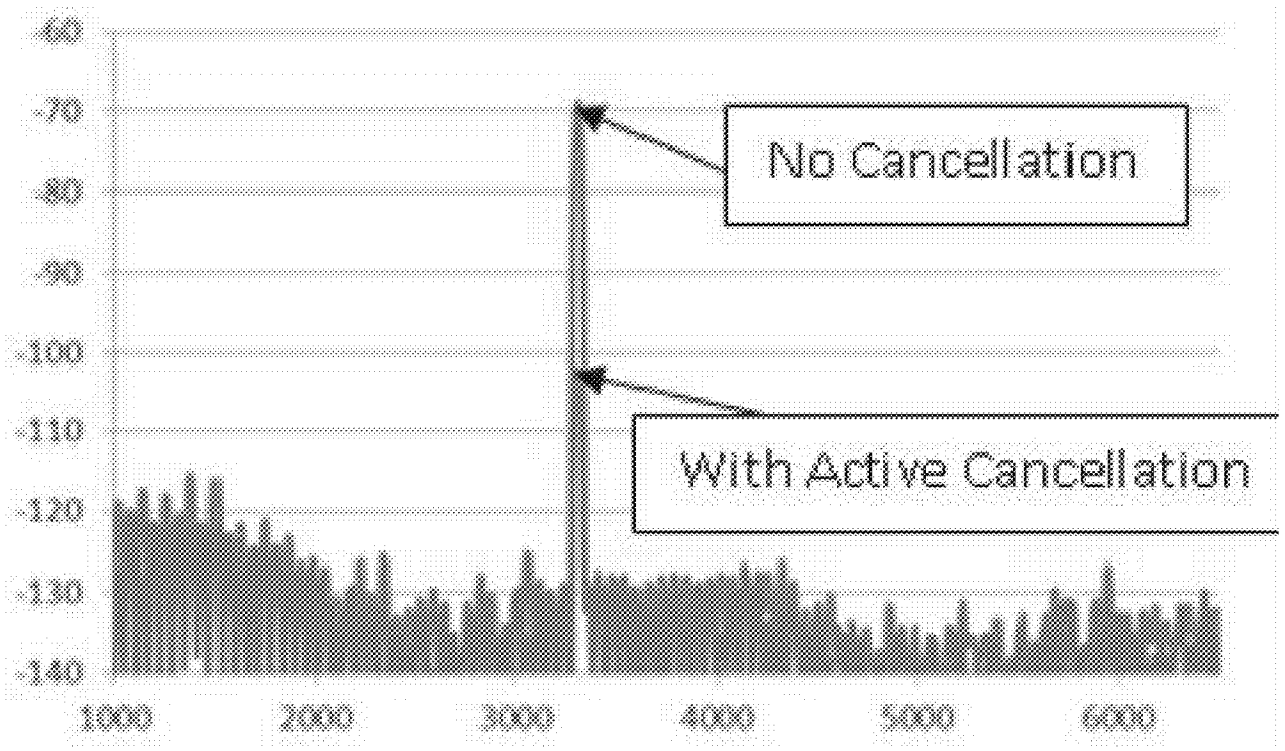
FIG. 12 is a graph showing results of an evaluation using the setup of FIG. 11.

FIG. 11 is a circuit schematic/block diagram illustrating another measurement setup for evaluating performance of the counter coil. This setup uses the circuit configuration discussed above with reference to FIG. 6. The rest of a hearing aid circuit (e.g., microphone and processor) was not included. An analog signal (sine wave) generated from the generator was applied to the receiver. FIG. 12 is a graph showing results of an evaluation using the setup of FIG. 11. Results of spectrum analysis of the sound signal with the counter coil being inactive ("No Cancellation") and with the counter coil being active ("With Active Cancellation") are presented. The results show that the counter windings when being active provide for an attenuation of electromagnetic interference by about 30 dB. While the measurement setups as illustrated in FIGS. 9 and 11 provide similar results in attenuation of electromagnetic interference, the setup with active circuit (FIG. 11) provides for an easier adjustment for the interference null. Use of an active circuit such as discussed in FIGS. 6 and 8 allows for automatic adjustment for the interference null after an hearing aid is manufactured and provided to the wearer.

Figure 13:
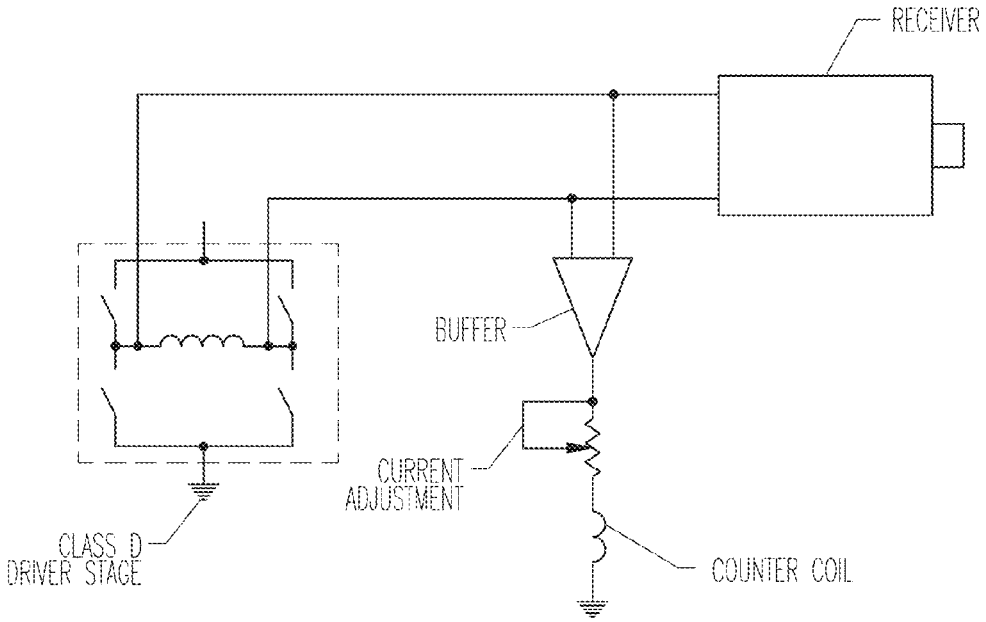
FIG. 13 is a circuit schematic/block diagram illustrating another measurement setup for evaluating performance of a counter coil.
Figure 14:
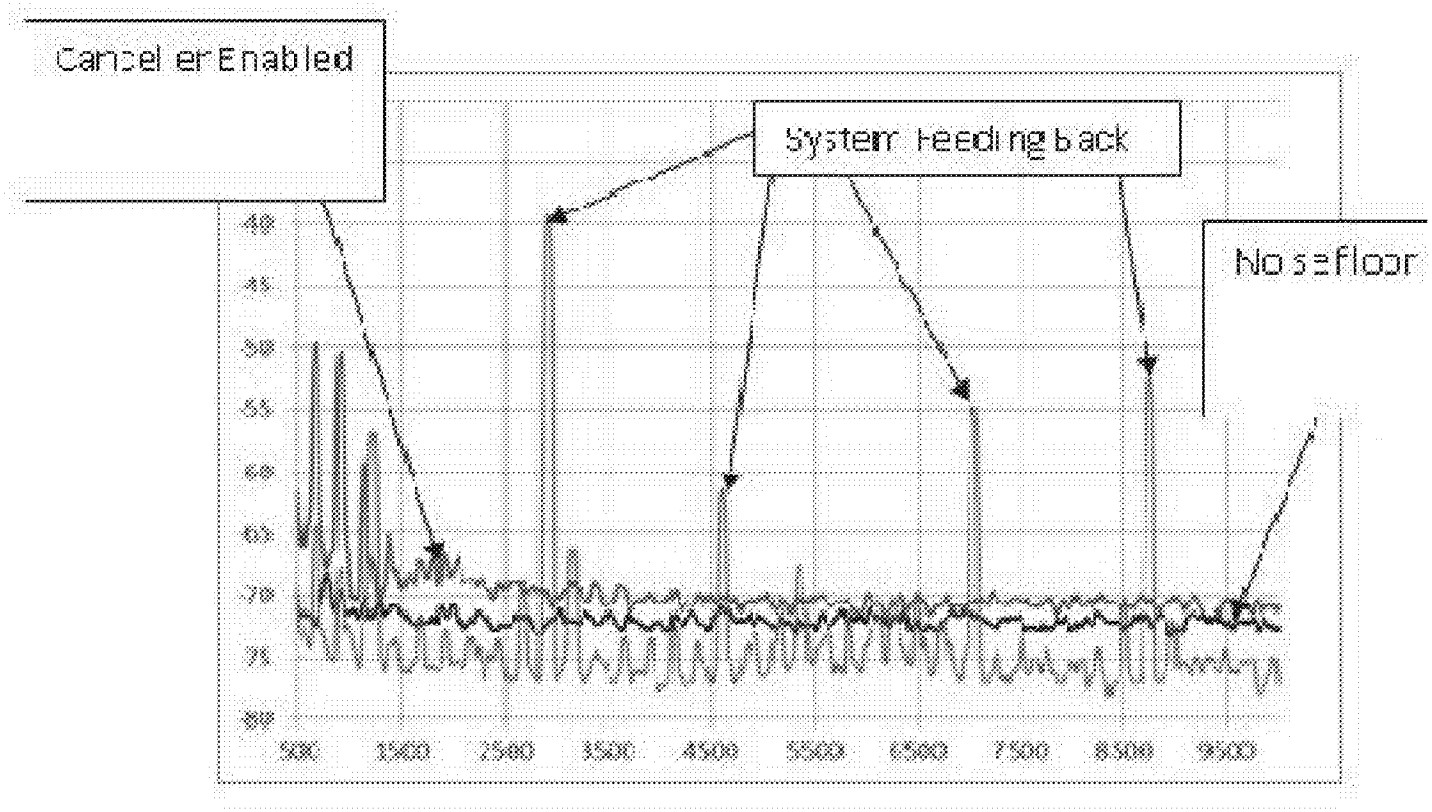
FIG. 14 is a graph showing results of an evaluation using the setup of FIG. 13.

FIG. 13 is a circuit schematic/block diagram illustrating a circuit used in another measurement setup for evaluating performance of the counter coil. The circuit is similar to that of the setup illustrated in FIG. 11 but includes the rest of the hearing aid circuit powered by a hearing aid battery. A class D driver stage was used as the generator. The high input impedance of the buffer (also powered by the hearing aid battery) had no impact on the class D driver. Functionality with the PPM signal was checked. The spacing between the receiver and the telecoil was based on the interference cancelling ability of the particular setup. The number of turns in the counter coil, the coupling ratio between the telecoil and the counter coil, and the variable resistor (or current source) adjustment were determined for cancelling the electromagnetic interference. FIG. 14 is a graph showing results of an evaluation using the setup of FIG. 13. Approximately 30 dB of attenuation was achieved by adjusting the variable resistor for appropriate cancelling current (i.e., the current flowing through the counter coil). Results of spectrum analysis of the sound signal without the telecoil being connected ("Noise floor"), with the amplified telecoil signal added to the noise floor with cancellation of electromagnetic interference enabled ("Canceller Enabled"), and feedback due to the telecoil's proximity to the receiver with cancellation of electromagnetic interference disabled ("System Feeding Back") are presented. This approach may be automated with the cancellation function implemented in the DSP. This would substitute the variable resistor (or discrete resistors) with an adjustable current source.

Hearing aid 100 is illustrated as a behind-the-ear (BTE) device in FIG. 5 by way of example and not by way of limitation. The counter coil as discussed in this document is used in any hearing aid in which a telecoil is employed. The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid for delivering a sound to an ear canal and having a component generating an ambient magnetic field, the hearing aid comprising:

a magnetic sensor configured to sense a sound signal being a sound magnetic field representing the sound, the magnetic sensor including:

a telecoil configured to sense the sound signal; and a counter coil configured to allow for generation of a counter signal being a counter magnetic field having a counter direction approximately opposite to a direction of a noise signal being the ambient magnetic field;

an active driver circuit coupled between the component and the counter coil, the active driver circuit configured to receive a current from the component and drive the counter coil using the received current, the active driver circuit including a current adjuster configured to adjust for an interference null by scaling the received current and passing the scaled current through the counter coil;

a processor configured to process the sound signal; and a receiver configured to deliver the processed sound signal to the ear canal.

2. The hearing aid of claim 1, wherein the counter coil is configured to allow for generation of the counter signal having a direction that is approximately 180-degree opposite to a direction of the sound signal.

3. The hearing aid of claim 2, wherein the telecoil comprises telecoil windings, and the counter coil comprises counter coil windings, the telecoil windings and the counter windings formed by winding wires in opposite directions.

4. The hearing aid of claim 3, wherein the telecoil windings and the counter windings are coaxial.

5. The hearing aid of claim 4, wherein the counter coil is formed by winding a wire over the telecoil.

6. The hearing aid of claim 1, wherein magnetic sensor comprises a single device integrating the telecoil, telecoil connectors allowing for electrical connections to the telecoil, the counter coil, and counter coil connectors allowing for electrical connections to the counter coil.

7. The hearing aid of claim 1, wherein the processor is configured to control the current adjuster to automatically adjust for the interference null.

8. The hearing aid of claim 7, wherein the active driver circuit is coupled between the receiver and the counter coil and configured to receive a receiver signal and drive the counter coil using the receiver signal.

9. The hearing aid of claim 7, further comprising a battery, and wherein the active driver circuit is coupled between the battery and the counter coil and configured to receive a battery signal and drive the counter coil using the battery signal.

10. A method for operating a hearing aid for delivering a sound to an ear canal, comprising:

sensing a sound signal using a telecoil, the sound signal being a sound magnetic field representing the sound;

generating a counter signal using a counter coil and a current signal flowing through the counter coil, the counter signal being a counter magnetic field having a counter direction approximately opposite to a direction of an noise signal being an ambient magnetic field generated by a component of the hearing aid;

producing the current signal by scaling a current received from the component using an active driver circuit coupled between the component and the counter coil;

adjusting the scaling of the current for an interference null; and processing the sound signal for delivery to the ear canal.

11. The method of claim 10, comprising generating the counter signal for the counter direction being approximately 180-degree opposite to a direction of the sound signal.

12. The method of claim 11, comprising generating the counter signal using the counter coil including counter windings having a direction opposite to a direction of telecoil windings of the telecoil.

13. The method of claim 12, comprising generating the counter signal using the counter coil wound over the telecoil.

14. The method of claim 9, comprising:

delivering the processed sound signal using a receiver, and generating the counter signal to cancel the ambient magnetic field generated by the receiver.

15. The method of claim 14, comprising:

receiving a receiver signal from the receiver;

scaling the receiver signal to produce the current signal using the active driver circuit, the active driver circuit coupled between the receiver and the counter coil; and applying the current signal to the counter coil to generate the counter signal.

16. The method of claim 15, comprising automatically controlling the adjustment of the scaling of the receiver signal for the interference null using a digital signal processor of the hearing aid.

17. The method of claim 16, comprising:

powering the hearing aid using a battery, and generating the counter signal to cancel the ambient magnetic field generated by the battery.

18. The method of claim 17, comprising:

receiving an AC-coupled battery signal from the battery;

scaling the battery signal to produce the current signal using the active driver circuit, the active driver circuit coupled between the battery and the counter coil; and applying the current signal to the counter coil to generate the counter signal.

19. The method of claim 18, comprising automatically controlling the adjustment of the scaling of the battery signal for the interference null using a digital signal processor of the hearing aid.

20. The hearing aid of claim 8, further comprising an H bridge circuit coupled between the receiver and the active driver circuit, the H bridge circuit configured to allow for control of polarity of the current flowing through the counter coil.

* * * * *